US007546867B2

(12) United States Patent
Naukkarinen et al.

(10) Patent No.: US 7,546,867 B2
(45) Date of Patent: Jun. 16, 2009

(54) SPIRALLY WOUND, LAYERED TUBE HEAT EXCHANGER

(75) Inventors: Olli Pekka Naukkarinen, Memphis, TN (US); Hailing Wu, Germantown, TN (US)

(73) Assignee: Luvata Grenada LLC, Grenada, MS (US)

( * ) Notice: Subject to any disclaimer, the term of this patent is extended or adjusted under 35 U.S.C. 154(b) by 0 days.

(21) Appl. No.: 11/315,108

(22) Filed: Dec. 21, 2005

(65) Prior Publication Data

US 2006/0108108 A1 May 25, 2006

Related U.S. Application Data

(63) Continuation-in-part of application No. 10/993,708, filed on Nov. 19, 2004.

(51) Int. Cl.
*F28F 9/22* (2006.01)
*F28F 13/12* (2006.01)

(52) U.S. Cl. ..... 165/145; 165/125; 165/163

(58) Field of Classification Search ..... 165/125, 165/145, 163, 172; 415/211.2
See application file for complete search history.

(56) References Cited

U.S. PATENT DOCUMENTS

| | | | | | |
|---|---|---|---|---|---|
| 1,942,676 | A | | 1/1934 | Williams | |
| 1,981,367 | A | | 11/1934 | Mason et al. | |
| 1,991,176 | A | | 2/1935 | Rutishauser | |
| 2,001,832 | A | * | 5/1935 | Bandurski | 165/125 |
| 2,044,832 | A | * | 6/1936 | Child | 165/125 |
| 2,119,761 | A | | 6/1938 | Wentworth | |
| 2,193,460 | A | * | 3/1940 | Lavigne | 165/163 |
| 2,241,186 | A | * | 5/1941 | Coons | 165/145 |
| 2,749,600 | A | | 6/1956 | Persson | |
| 2,828,723 | A | | 4/1958 | Miller | |
| 2,998,228 | A | | 8/1961 | Huet | |
| 3,111,168 | A | | 11/1963 | Huet | |
| 3,130,780 | A | * | 4/1964 | Winship | 165/163 |
| 3,144,081 | A | | 8/1964 | Skiba | |
| 3,249,154 | A | | 5/1966 | Legrand | |
| 3,326,282 | A | | 6/1967 | Jenssen | |
| 3,712,370 | A | * | 1/1973 | Gilli et al. | 165/125 |
| 3,720,259 | A | * | 3/1973 | Fritz et al. | 165/163 |
| 3,742,567 | A | | 7/1973 | Kaelin | |
| 3,809,061 | A | * | 5/1974 | Gerstmann | 165/163 |
| 4,116,270 | A | | 9/1978 | Marushkin et al. | |
| 4,241,785 | A | | 12/1980 | O'Connor et al. | |
| 4,484,624 | A | | 11/1984 | Vleggaar et al. | |
| 4,605,059 | A | | 8/1986 | Page | |
| 4,778,004 | A | * | 10/1988 | Paulman et al. | 165/150 |

(Continued)

FOREIGN PATENT DOCUMENTS

| | | |
|---|---|---|
| GB | 644651 | 3/1948 |

(Continued)

*Primary Examiner*—Leonard R Leo
(74) *Attorney, Agent, or Firm*—Hodgson Russ LLP

(57) ABSTRACT

A spirally wound tube heat exchanger 10 article that receives a heat exchange fluid and its method of manufacture. In one embodiment, the exchanger 10 has one or more spirally-wound layers 12 of a tube 14. In some embodiments, the layers are circular, oval or rectangular with radiused corners. An elongate spacer member 24 has forwardly 26 and rearwardly 28 facing edges. Defined within those edges are engagement surfaces 30 that detachably retain the tube 14.

7 Claims, 5 Drawing Sheets

U.S. PATENT DOCUMENTS

| | | | | |
|---|---|---|---|---|
| 5,099,916 | A | 3/1992 | Vollhardt | |
| 5,472,047 | A | 12/1995 | Welkey | |
| 5,787,722 | A * | 8/1998 | Jenkins | 165/162 |
| 2004/0028940 | A1 | 2/2004 | Toyama et al. | |
| 2004/0050540 | A1 | 3/2004 | Kato et al. | |
| 2004/0069465 | A1 * | 4/2004 | Lee | 165/125 |

FOREIGN PATENT DOCUMENTS

| | | |
|---|---|---|
| GB | 607717 | 9/1948 |
| GB | 656519 | 8/1951 |

* cited by examiner

SPIRALLY WOUND, LAYERED TUBE HEAT EXCHANGER

CROSS-REFERENCE TO RELATED APPLICATIONS

This application is a continuation-in-part of U.S. application Ser. No. 10/993,708, filed Nov. 19, 2004, which is incorporated herein by reference.

BACKGROUND OF THE INVENTION

1. Field of the Invention

This invention relates generally to tube configurations used in heat exchangers and their methods of manufacture.

2. Background Art

In many chemical, electronic, and mechanical systems, thermal energy is transferred from one location to another or from one fluid to another. Heat exchangers allow the transfer of heat from one fluid (liquid or gas) to another fluid. Conventionally, the reasons for transferring heat energy are:

(1) to heat a cooler fluid using a warmer fluid;

(2) to reduce the temperature of a hot fluid by using a cooler fluid;

(3) to boil a liquid using a hotter fluid;

(4) to condense a gas by a cooler fluid; or (5) to boil a liquid while condensing a hotter fluid in the gaseous state.

Regardless of the function the heat exchanger fulfills, in order to transfer heat, the fluids in thermal contact must be at different temperatures to allow heat to flow from the warmer to the cooler fluid according to the second principle of thermodynamics.

Traditionally, for round tube fin heat exchangers there is no direct contact between the two fluids. Heat is transferred from the fluid to the material isolating the two fluids and then to the cooler fluid.

Some of the more common applications of heat exchangers are found in the heating, ventilation, air conditioning and refrigeration (HVACR) systems, electronic equipment, radiators on internal combustion engines, boilers, condensers, and as pre-heaters or coolers in fluid systems.

All air conditioning and refrigeration systems contain at least two heat exchangers—usually an evaporator and a condenser. In each case, the refrigerant flows into the heat exchanger and participates in the heat transfer process, either gaining or releasing it to the medium to be used. Commonly, the cooling medium is air or water.

A condenser accomplishes this by condensing the refrigerant vapor into a liquid, transferring its phase change (latent) heat to either air or water. In the evaporator, the liquid refrigerant flows into the heat exchanger. Heat flow is reversed as refrigerant evaporates into a vapor and extracts heat required for this phase change from the hotter fluid flowing on the other side of the tubes.

Tubular heat exchangers include those used in an automotive heat exchanger environment, such as a radiator, a heater coil, an air cooler, an intercooler, an evaporator and a condenser for an air-conditioner. For example, a hot fluid flows internally through pipes or tubes while a cooler fluid (such as air) flows over the external surface of the tubes. Thermal energy from the hot internal fluid is transferred by conduction to the external surface of the tubes. This energy is then transferred to and absorbed by the external fluid as it flows around the tubes' outer surfaces, thus cooling the internal fluid. In this example, the external surfaces of the tubes act as surfaces across which thermal energy is transferred.

Traditionally, longitudinal or radial fins may be positioned in relation to the external surface of the tubes to turbulate the externally flowing fluid, increase the area of the heat transfer surface and thus enhance the heat transfer capacity. One disadvantage, however, is that fins add to material and manufacturing cost, bulk, handling, servicing and overall complexity. Further, they occupy space and therefore reduce the number of tubes that can fit within a given cross sectional area. Also, they collect dust and dirt and may get clogged, thereby diminishing their effectiveness.

Densely configured external fins tend to constrict external fluid flow. This increases the pressure drop of the external fluid across the heat transfer surface and may add to heat exchanger costs by requiring more pumping power. In general, expense related to pumping is a function of the pressure drop.

Fin-less, tube heat exchangers are known. See, e.g., U.S. Pat. No. 5,472,047 (Col. 3, lines 12-24). Conventionally, however, they are made of tubes having a relatively large outside diameter. Often, tubes are joined with wires, such as the steel coils found at the back of many residential refrigerators.

The U.S. references identified during a pre-filing investigation were: US 2004/0050540 A1; US 2004/0028940 A1; U.S. Pat. Nos. 5,472,047; 3,326,282; 3,249,154; 3,144,081; 3,111,168; 2,998,228; 2,828,723; 2,749,600; and 1,942,676.

Foreign references identified during a pre-filing investigation were: GB 607,717; GB 644,651; and GB 656,519.

SUMMARY OF THE INVENTION

Against this background, it would be desirable to provide a uniformity of flow of external heat exchange fluid across layers of tube and between tubes in a layer within which an internal heat exchange fluid passes, thereby avoiding areas of stagnation that reduce the efficiency of the heat exchange process.

Additionally, it would be desirable to provide a heat exchanger that can be made relatively inexpensively and efficiently without requiring undue complexity in the manufacturing process.

Accordingly, the invention includes a heat exchanger that transfers thermal energy between an internal heat exchange fluid that flows within the tubing and an external heat exchange fluid in thermal communication with the internal heat exchange fluid.

The heat exchanger includes one or more layers of a tube within which the internal heat exchange fluid passes. At least some of the one or more layers has a spiral configuration with at least some segments that lie on an imaginary frustoconical surface. By configuring the average spacing between tubes in a layer and/or the spacing between adjacent layers, uniformity of flow of the external heat exchange fluid across the layers and between the tubes is promoted, thereby improving the efficiency of heat transfer.

Preferably, at least one spacer member supports one or more of the layers. Each spacer member has forwardly and rearwardly facing edges. Those edges define engagement surfaces which detachably retain tubes in the layers.

The invention also includes a method of making such a heat exchanger. The method comprises the steps of providing an elongate, cone-shaped mandrel; and winding one or more lengths of tubing around the mandrel so as to prepare a spiral configuration.

BRIEF DESCRIPTION OF THE DRAWINGS

FIG. 7 is a graph of velocity vectors shaded according to velocity magnitude.

DETAILED DESCRIPTION OF THE PREFERRED EMBODIMENT(S)

Figure 1:
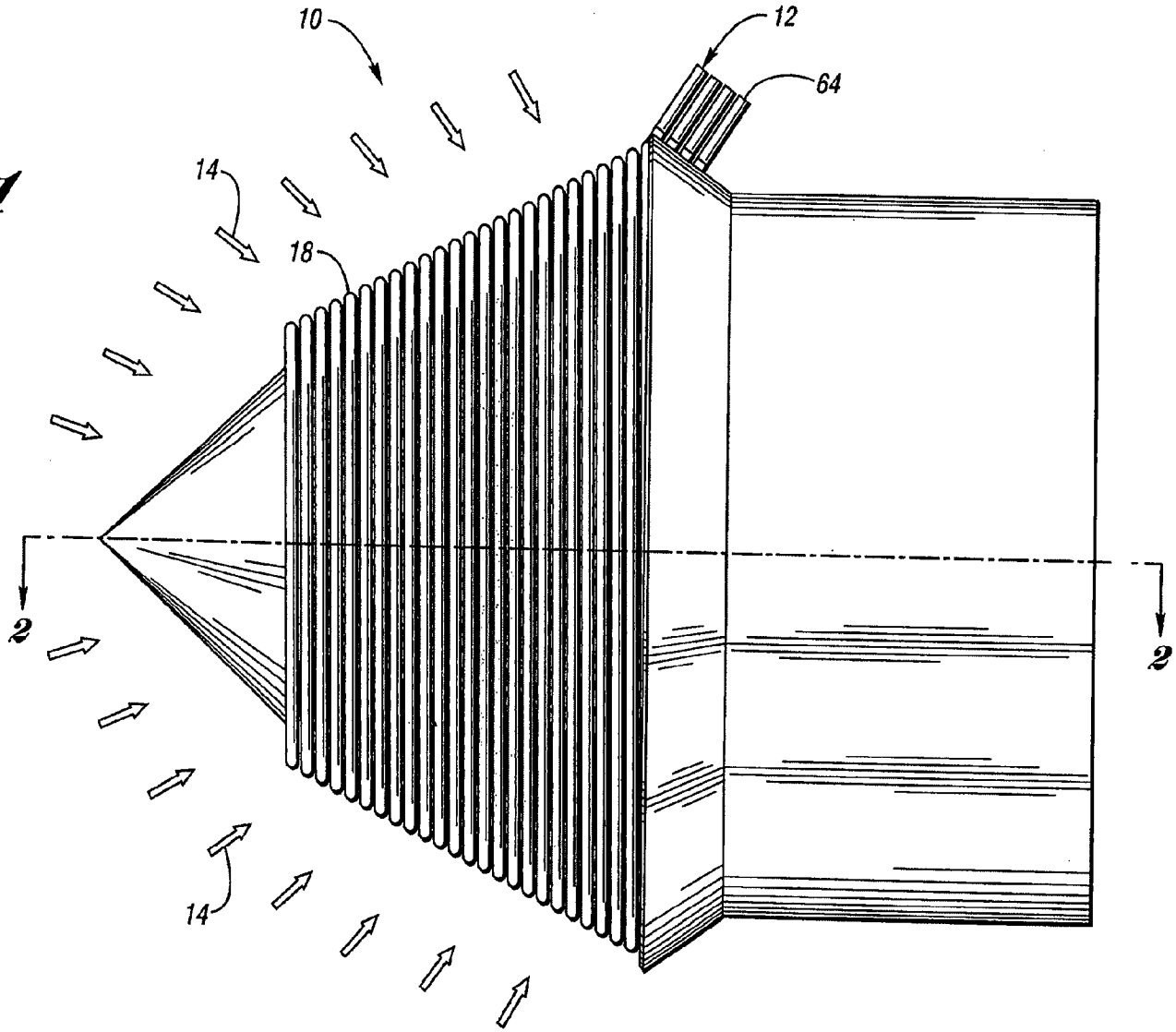
FIG. 1 is a side view of an embodiment of a heat exchanger according to the present invention which has four layers of tubing.
Figure 2:
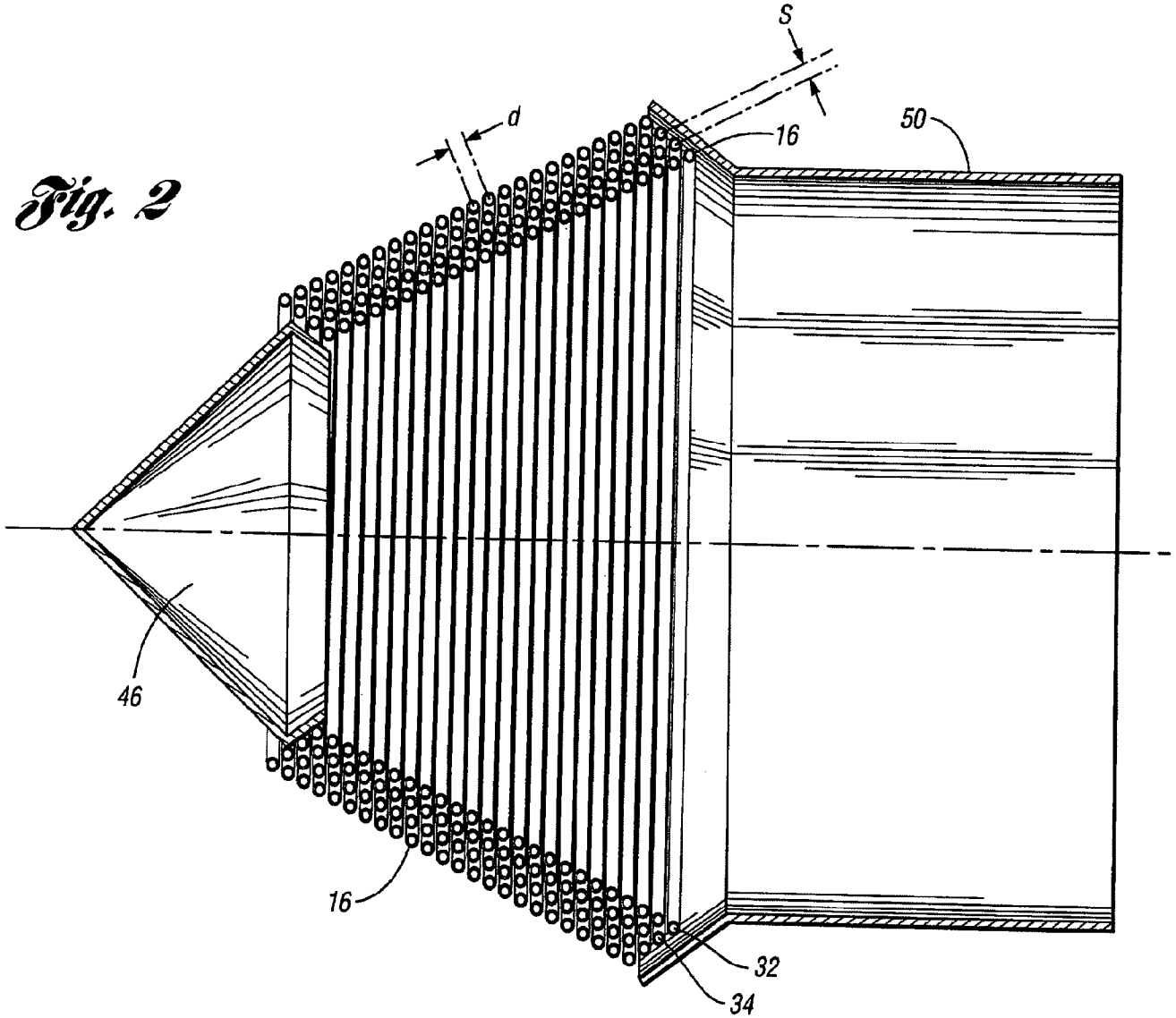
FIG. 2 is a cross section view thereof taken along the line 2-2 of FIG. 1.

FIGS. 1-4 respectively depict a side and axial cross sectional view of preferred and alternate embodiments of a heat exchanger assembly 10. The assembly transfers thermal energy between an internal heat exchange fluid 12 that flows within the exchanger and an external heat exchange fluid 14 (such as but not limited to an air flow) that is in thermal communication with the internal heat exchange fluid 12. The fluids 12, 14 could be gas, liquid or gas-liquid in any combination. In one form, the heat exchange assembly 10 includes one or more layers of tube or tubing 16 (FIG. 2) within which the internal heat exchange fluid 12 passes. At least some of those layers preferably have a spiral configuration, as depicted in FIGS. 1-2. In that spiral configuration, at least some segments 20 lie on an imaginary frustoconical surface.

As used herein, the term "spiral" includes but is not limited to a three-dimensional curve that turns around an axis at a continuously varying distance while moving parallel to the axis. It will be appreciated that the rate of change of the continuously varying distance may be constant or variable so as to produce a more or less accentuated spiral form, depending on the thermodynamic requirements of a particular application. As used herein, the term "spiral" includes the term "helix".

The layers of tubing are characterized by an inter-layer spacing S and an average distance d from a tube center to the center of an adjacent tube (FIG. 2). Distance d can be either fixed, variable, or a combination of fixed and variable within a given layer. In some embodiments, the dimension d is equal to or less than twice the average outside diameter of tubing. The dimension (S) can be fixed, variable, or a combination of fixed and variable between the layers in a given configuration. Preferably, S is less than 2×OD. By suitable selection of inter-layer spacing (S) and adjustment of the distance d between adjacent tubes in a given layer, the spiral configuration of tube layers promotes uniformity of flow of the external heat exchange fluid 14 across the layers 16.

Figure 5:
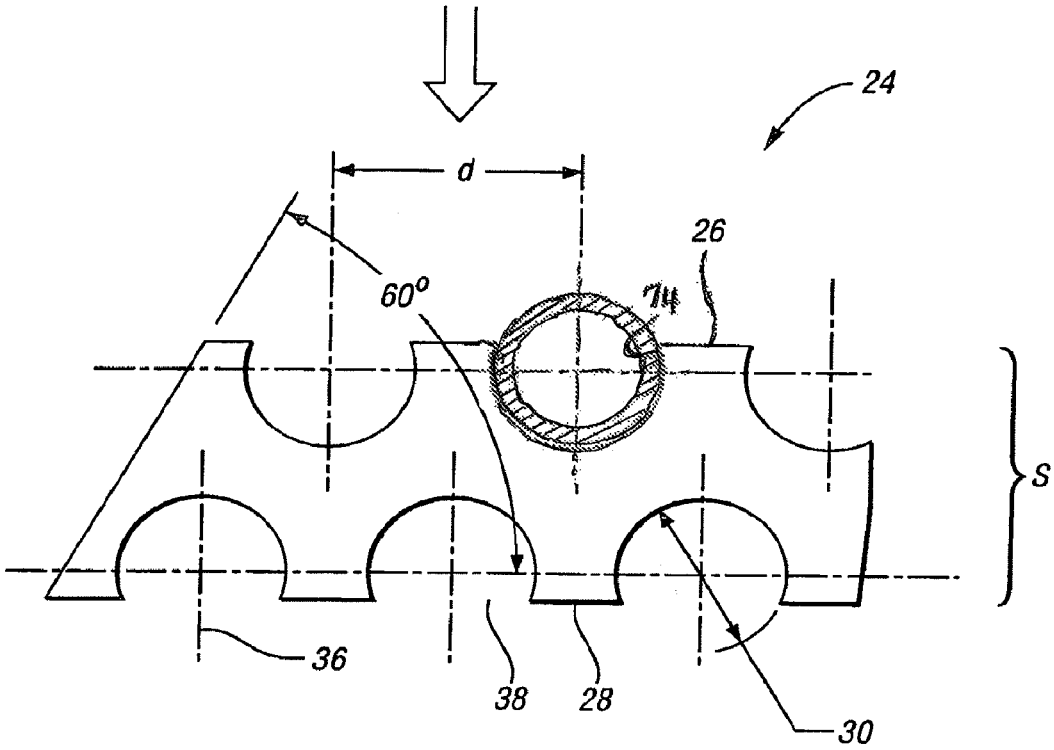
FIG. 5 is a side view of a portion of a spacer member that supports layers of tubing.

Preferably, a spacer member 24 (FIG. 5) supports one or more of the one or more layers so that the dimensions S and d can be pre-defined. There can be one or more spacer members 24 that support the layers in a given spiral configuration. Each spacer member has a forwardly and rearwardly facing edge 26,28 (in relation to the flow of external heat exchange fluid). The edges 26,28 define engagement surfaces 30 that detachably retain the layers 16. In one embodiment, the forwardly facing edges 26 may retain segments of one layer while the rearwardly facing edges 28 retain segments of an adjacent layer. As shown in FIG. 5, the engagement surfaces 30 comprise a truncated form having an open portion 38 that is sized less than the outside diameter (OD) of the tube. As shown in FIG. 5, an elongate spacer member 24 defines engagement surfaces 30 that detachably retain segments 20 of the tubing. The engagement surfaces 30 are defined within the forwardly 26 and rearwardly 28 facing edges. In one embodiment, the forwardly facing edge 26 detachably retains one run of one revolution 32 of the spiral configuration 15. The rearwardly facing edge 28 detachably retains a run of an adjacent layer.

It will be appreciated that additional spacer members 24 may be provided within the same heat exchanger. The spacer members 24 may or may not be parallel with each other and may or may not extend perpendicularly in relation to the layers 16.

An additional attribute of the spacer member 24 is that it supports the three-dimensional shape of the tube heat exchanger. Although one spacer member 24 is depicted in FIG. 5, it will be appreciated that other spacer members could additionally be deployed within a given heat exchanger. Additional spacer members 24 could for example, serve to deflect air flow advantageously so that the predominant air flow occurs through the central regions of the heat exchanger where certain coil segments run in close parallel proximity. Also, the spacer member 24 may serve as a thermal communication member between tubes and layers.

Figure 6:
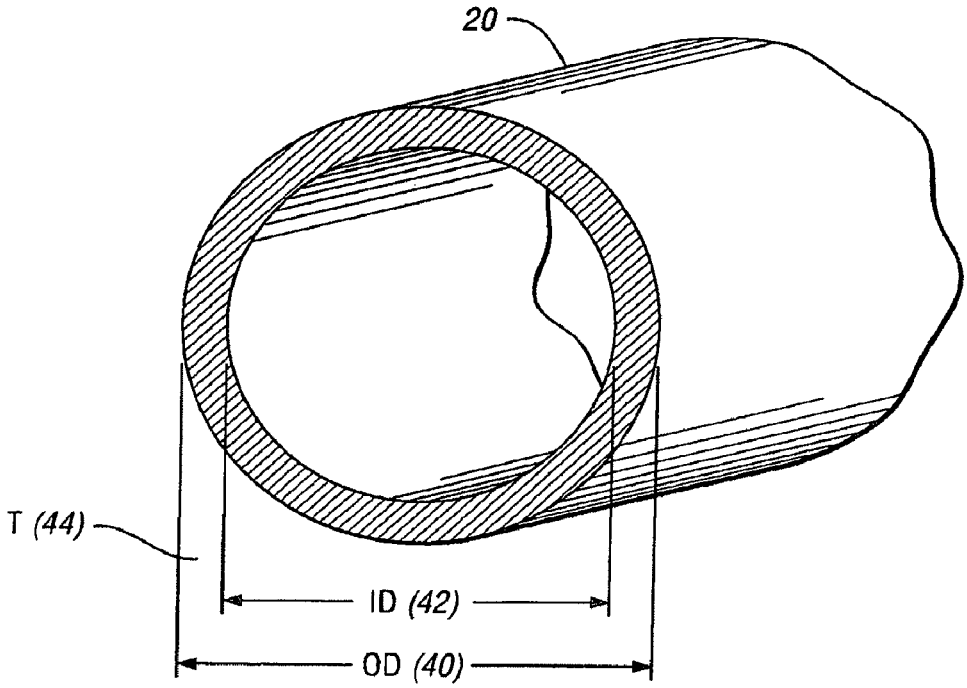
FIG. 6 is a lateral cross sectional view of a representative tube in a representative layer of the heat exchanger according to the present invention.
Figure 9:
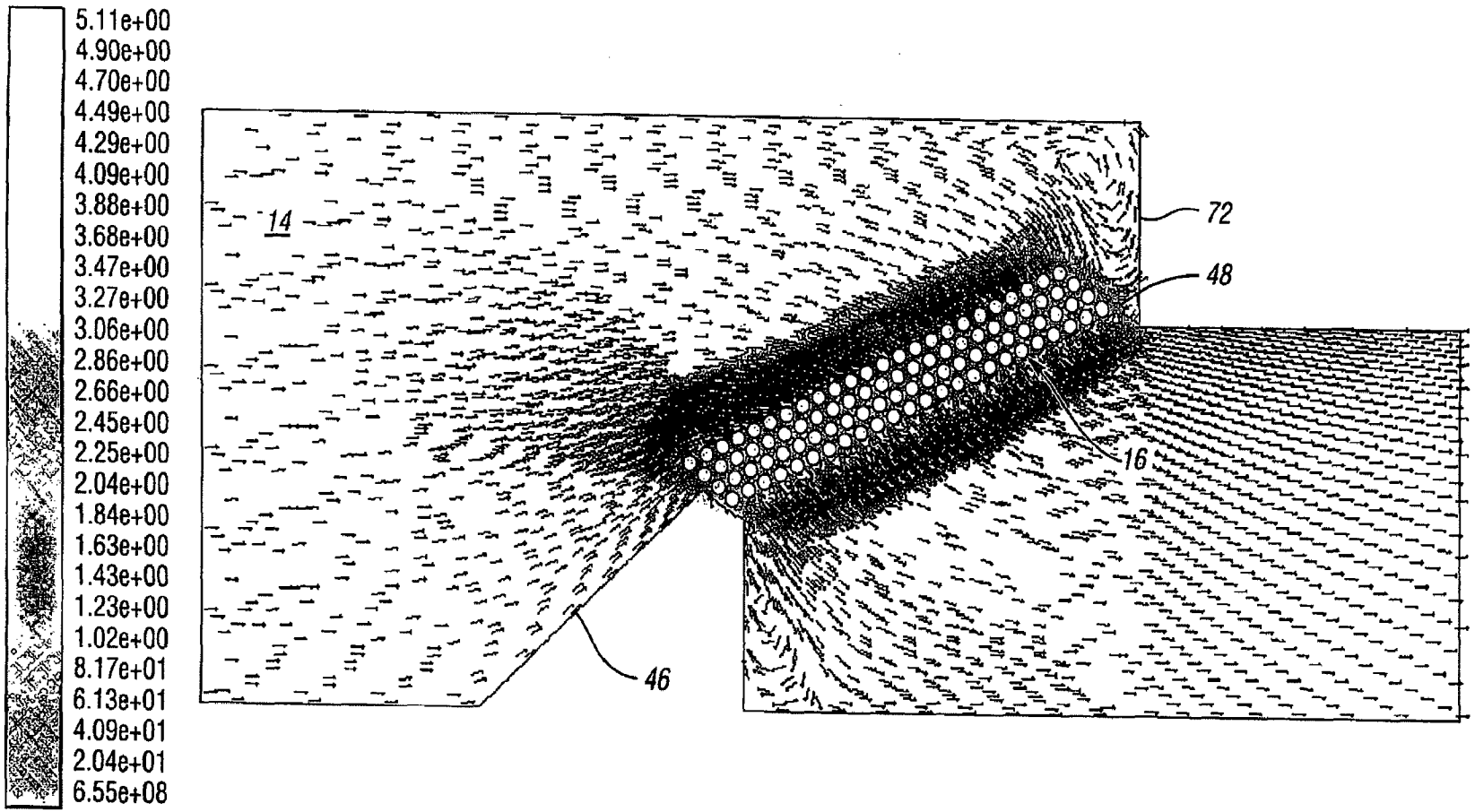

Some identifying characteristics of a segment of tubing are depicted in FIG. 6. There, it can be seen that the tube has an average outside diameter (OD), an average inside diameter (ID) and an average wall thickness (T). In general, (T=OD−ID)/2. In some embodiments, the ratio of (T) to (OD) is between 0.01 and 0.1. The heat exchanger has one or more layers 16 of discrete tubing or tubes (one per layer), or a single, long, continuous, tube. It will be appreciated that the tube need not be circular or annular in cross section. For some applications, for example, the tube may usefully have an oval configuration or other non-circular cross section which may be helpful in directing incident air flow ("external heat exchange fluid", 14) with less pressure loss and/or promoting local turbulence. Tubes may contain multiple ports. For example, a given tube may contain multiple passages or lumens. At least some of the one or more layers 16 have a circular, an ovate, oblong, or racetrack-like spiral configuration 18 (FIGS. 1-2).

Figure 3:
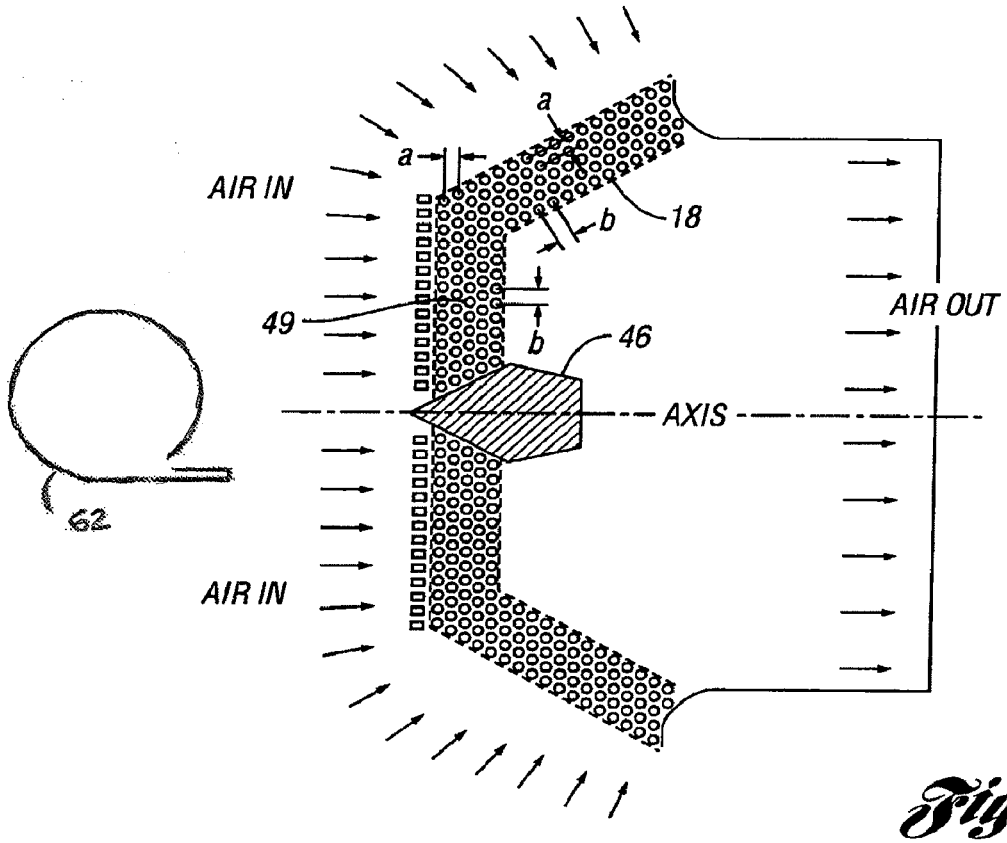
FIG. 3 is a cross sectional view of a first alternate embodiment thereof.

In one embodiment, a heat exchanger assembly is contemplated by the present invention. The assembly includes the spiral configuration of tube heat exchanger (FIGS. 1-4), at least one spacer member, a leading nose 46 (FIGS. 1 and 2), a guiding baffle 48 (FIGS. 2-4), and a blower 62 (FIG. 3).

Thus, it will be appreciated that the depicted spiral configuration (FIGS. 1-4) is one example of a contoured configuration. In some examples, the contoured configuration may have a circular axial cross section (instead of the frustoconical spiral configuration depicted in FIG. 2), a triangle, a rectangle, a polygon, an oval, an oblong, an ellipse, and combinations thereof. To support such combinations, the spacer members are provided with a geometry appropriate to the form desired. The spacer members 24 position adjacent tube layers. Detents or engagement surfaces 30, preferably frusto-circular if round tubes are used, are defined within edges 26,28 of the spacer. These detents 30 terminate at the spacer edges in a position that is slightly offset from a major diameter of a detent, which may be circular, or non-circular. In this way, the outside diameter of a tube segment is engaged by a snap fit within the spacer. The distance between consecutive detents (d) (center-to-center of the grooves) influences one heat transfer characteristic of the heat exchanger. In one preferred embodiment, this distance is twice the outside diameter (OD) of the tube.

In some embodiments, at least some of the one or more layers include tubes with centers that lie on the same imaginary line, as suggested in FIG. 2. Alternatively, the tubes of every second layer may lie on the same line with various offsets compared to tubes of adjacent layers.

In FIG. 7, external heat exchange fluid flows from left to right. Velocity vectors are suggested by the directional arrows. The view in FIG. 7 schematically depicts the upper half of an axial section of a heat exchange duct (FIG. 2). As external heat exchange fluid 14 impacts the leading nose 46, it is unable to pass therethrough. The incident external heat exchange fluid 14 then is directed away from the nose 46 and toward the layers 16 of (in one form) a spiral configuration of heat exchanger. An area of stagnancy occurs ahead of wall 72. A confluence of incident external heat exchange fluid is urged, at least partially assisted by one or more guiding baffles 48, to enter the layers 16.

Other things being equal, the velocity of external heat exchange fluid 16 that passes through a central region of the layers 16 would conventionally exceed the velocity at which external heat exchange fluid 14 traverses the layers toward their upper right hand—and lower left hand (as seen in FIG. 7) areas. To promote the uniformity of flow and thereby enhance the efficiency of heat transfer, the inter-tube spacing (d) in a given layer and the inter-layer spacing (S) in a given configuration can be adjusted. As a result of the adjustment, barriers to flow, which causes stagnancy in adjacent area, may be eased.

Although a rounded segment 20 of tube is depicted in FIG. 6, it will be appreciated that the tube may also have a cross sectional profile that is circular, oval, elliptical, rectangular (with or without rounded corners) and combinations thereof. Tubes may contain multiple ports (as noted earlier), and/or may be enhanced with internal or external surface microstructures, such as but not limited to grooves or a grain texture.

The invention also includes a method of making such a heat exchanger. In general, the method comprises the steps of providing an elongated mandrel. In one manufacturing process, the mandrel has an outside surface in which one or more continuous helical grooves are defined. During the winding steps, the tube becomes accommodated by the helical groove. If a spiral configuration is desired, the mandrel preferably is cone-shaped. A continuous length of a tube is then wound around the mandrel so as to prepare the windings, each winding having a spiral configuration.

FIG. 2 depicts an alternate embodiment heat exchanger in which there are multiple layers. In practice, the innermost coil is first formed on a mandrel or spacer member 24 (FIG. 5). An outer layer is then wound around on top of it. Positioning of adjacent coils in a given layer and between the layers themselves is enabled by a selection of suitable spacer geometry. It should be appreciated that if desired, the tube diameter in an innermost layer may differ from that found in an outermost layer. In such embodiments, it is preferable that the outside diameter of the innermost tube layers exceeds that found in the outermost tube layers.

In some cases, the spacer member 24 itself may assume the function of a mandrel. In such cases, a length of tubing is wound around the spacer. It will be appreciated that a given spacer member may itself be solid, or hollow. One example is that of a spacer formed by a pair of plates that are separated by an interstitial support member. Optionally, the mandrel may contain the spacers prior to winding.

Returning to FIGS. 1-2, a leading nose 46 is presented to the external heat exchange fluid 14. The leading nose 46 extends ahead of the spiral configuration 18 of layer 16. A guiding baffle 48 (FIG. 2) is positioned in relation to the layer 16 so that it directs the flow of the external heat exchange fluid between the tubes in a layer and between layers in the one or more layers of tubing.

In FIG. 3, a planar region of layers 49 is juxtaposed between the leading nose 46 and at least some of the one or more layers have a spiral configuration 18.

Figure 4:
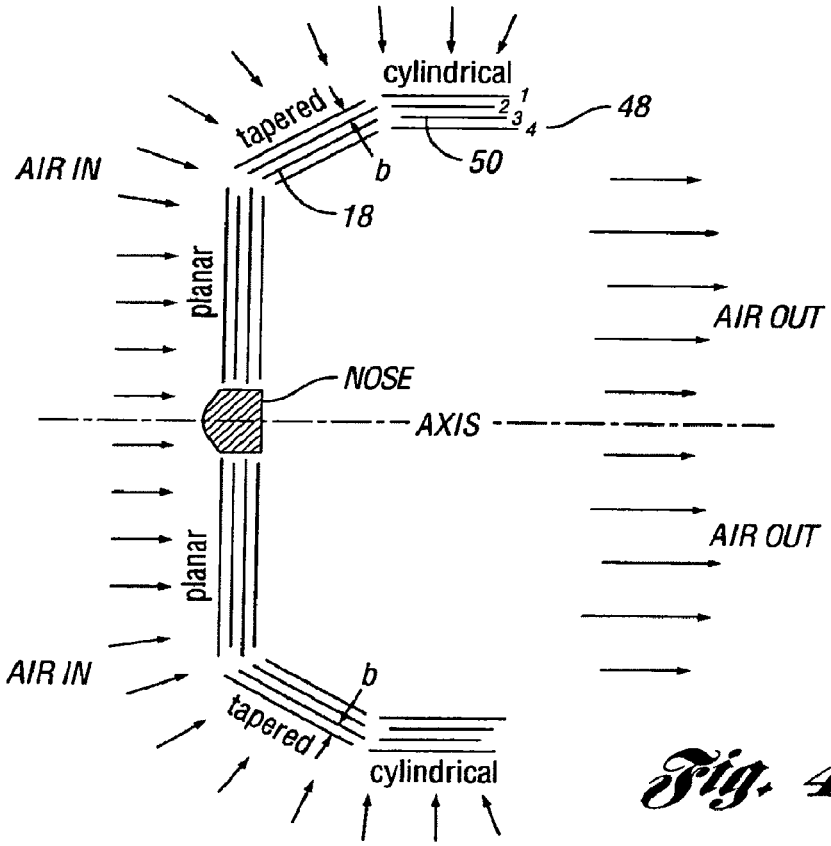
FIG. 4 is a cross sectional view of a second alternate embodiment thereof.

FIG. 4 depicts a second alternate embodiment of the invention. In that embodiment, a cylindrical region 50 of layers is juxtaposed between the spiral configuration 18 and the guiding baffle 48.

FIGS. 1-2 depict bundles of coiled tubing that serve as a heat exchanger having a spiral configuration 18 in a heat exchanger assembly 10. Noteworthy in the embodiment depicted is the absence of fins or louvers (with the exception of spacer members) that are often used in heat exchangers to promote air flow and thus the efficiency of thermal energy transfer.

In FIG. 1, a heat exchanger fluid enters a coiled tube at an inlet. In several applications, the incoming fluid is a refrigerant or another liquid such as water that is suitable for heat transfer. In some cases, the water could be introduced at a relatively high temperature. In such applications, the heat exchanger serves to elevate the temperature of a fluid such as air that passes around and outside the coiled tubes.

One consequence of a staggered (as opposed to an in-line) configuration of tubing is that there are relatively few spaces in the heat exchanger through which fluid flowing outside the tubes can pass without interruption. Because of the relatively disturbing alignment of the tube configuration depicted, fluid flowing around the outside of the tubes is in thermal contact for a protracted period ("dwell time") with the tube runs that are positioned above and below the spacer 24.

For configurations where only one circuit is applied, no headers are needed at the inlet or the outlet side of the heat exchanger. Nor are there any serpentine fins or louvers. Accordingly, in a preferred embodiment, the heat exchanger effectively is a wound layered tube apparatus. Hence, it is less expensive to manufacture and maintain than conventional round tube plate fin heat exchangers. For multiple circuits, internal fluid distributors may be used to distribute the internal fluid into multi-inlets and collect the fluid from multi-outlets.

Preferably, the spacer member 24 (FIG. 5) is formed from a deformable material primarily to accommodate a snap fitting engagement with the tubing. If desired, the spacing member 24 may be formed from a heat conducting or insulating material. If so, heat may be transferred efficiently between tube surfaces, or isolated between the two.

The heat exchanger tubes can be made from any heat-conducting material. Metals, such as copper or aluminum are preferred, but plastic tubes having a relatively high thermal conductivity or a thin wall may also be used.

The practical relationships between the tube inside diameter (ID), outside diameter (OD), and wall thickness (T) are somewhat limited by the manufacturing techniques used to form the tube. Clearly, the selection of suitable dimensions will influence the pressure-bearing capability of the resulting heat exchanger. In general, it can be stated that as the outside diameter (OD) decreases, the thinner the wall section (T) can be. Preferably, the outside diameter (OD), inside diameter (ID) and thus wall thickness (T) are selected so that the tube can hold the pressure of an internal heat exchange fluid without deformation of the tube material. When the outside diameter decreases, the ratio of tube outer surface over internal volume of the tube increases. As a consequence, there is more heat transfer area per internal fluid volume.

As is apparent from the drawings, the spacer member 24 prevents tube migration. Preferably, the spacing of detents 30 within the spacer member 24 is such as to cause the runs of consecutive layers to lie closely together or be spaced apart. This results in a control over packing density that influences resistance to the flow of external heat exchange fluid, local turbulence, laminar flow, and consequent management over the efficiency of heat transfer.

One drawback of conventional evaporators is that water condensate tends to accumulate at various locations within the heat exchanger. This tends to block the air flow. By positioning the invention in a vertical orientation (FIG. 1), however, this problem is avoided because any condensate flows downwardly under gravity and away from the central portion of the heat exchanger. This process may be facilitated through the spacer members.

If desired, the embodiments of FIGS. 1 and 2 could be connected in series or parallel. Parallel configurations could be helpful when more capacity is needed. Such configurations may be advantageous where a long tube length may cause too high of a pressure drop and thus internal fluid flow is limited. In such arrangements it may be useful to use fluid distributors to provide the distribution of internal fluid flow to inlets and the confluence from outlets.

Returning briefly to FIG. 5, there is depicted one tube in a layer that is engaged by an opening in the spacer member 24, and a bond 74 existing therebetween. The bond is selected from the group consisting of an adhesive and a metallurgical material.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A heat exchanger assembly comprising:

a leading nose that is presented to an external heat exchange fluid;

multiple layers of tubing within which an internal heat exchange fluid passes, at least some of the multiple layers having a spiral configuration with at least some segments that lie upon an imaginary frustoconical surface;

a planar region of layers juxtaposed between the leading nose and at least some of the multiple layers having a spiral configuration;

a guiding baffle that is positioned in relation to the multiple layers of tubing so that the multiple layers are juxtaposed between the planar region of layers and the guiding baffle, the guiding baffle for directing the flow of the external heat exchange fluid between tubes in a layer and between layers in the multiple layers of tubing; and one or more planar spacer members that support the multiple layers of tubing, each of the one or more planar spacer members has a forwardly facing edge and a rearwardly facing edge, and each of the forwardly and rearwardly facing edges have detents having a truncated form with an opening smaller than an outside diameter (OD) of the tubing and terminate at the forwardly and rearwardly spacer edges in a position that is offset from a major diameter of the detents, and the multiple layers of tubing are detachably retained by the detents defined in the forwardly and rearwardly facing edges with a snap fit.

2. The heat exchanger of claim 1, wherein the one or more planar spacer members detachably retain segments of an adjacent layer.

3. The heat exchanger of claim 1, wherein the tubing has an average outside diameter (OD), an average inside diameter (ID) and an average wall thickness (T=(OD−ID)/2), wherein the ratio of(T) to (OD) is between 0.01 and 0.1.

4. A heat exchanger assembly comprising:

a leading nose that is presented to an external heat exchange fluid;

multiple layers of tubing within which an internal heat exchange fluid passes, at least some of the multiple layers having a spiral configuration with at least some segments that lie upon an imaginary frustoconical surface;

a guiding baffle that is positioned in relation to the layers of tubing so that the layers are juxtaposed between the leading nose and the guiding baffle, the guiding baffle serving to direct the flow of the external heat exchange fluid between tubes in a layer and between layers in the multiple layers of tubing; and, a planar region of layers juxtaposed between the leading nose and at least some of the one or more layers having a spiral configuration.

5. A heat exchanger assembly comprising:

a leading nose that is presented to an external heat exchange fluid;

multiple layers of tubing within which an internal heat exchange fluid passes, at least some of the multiple layers having a spiral configuration with at least some segments that lie upon an imaginary frustoconical surface;

a guiding baffle that is positioned in relation to the layers of tubing so that the layers are juxtaposed between the leading nose and the guiding baffle, the guiding baffle serving to direct the flow of the external heat exchange fluid between tubes in a layer and between layers in the multiple layers of tubing; and, a cylindrical region of layers juxtaposed between the spiral configuration and the guiding baffle.

6. A heat exchanger assembly comprising:

a leading nose that is presented to an external heat exchange fluid;

multiple layers of tubing within which an internal heat exchange fluid passes, at least some of the multiple layers having a spiral configuration with at least some segments that lie upon an imaginary frustoconical surface;

a guiding baffle;

a cylindrical region of layers is juxtaposed between the multiple layers and the guiding baffle;

wherein leading nose is positioned in relation to the multiple layers of tubing such that the multiple layers are juxtaposed between the leading nose and the cylindrical region of layers, and the cylindrical region of layers are juxtaposed between the multiple layers of tubing and the guiding baffle, wherein the guiding baffle is for directing the flow of the external heat exchange fluid between tubes in a layer and between layers in the cylindrical region of layers; and one or more planar spacer members that support the multiple layers of tubing, each of the one or more planar spacer members has a forwardly facing edge and a rearwardly facing edge, and each of the forwardly and rearwardly facing edges have detents having a truncated form with an opening smaller than an outside diameter (OD) of the tubing and terminate at the forwardly and rearwardly spacer edges in a position that is offset from a major diameter of the detents, and the multiple layers of tubing are detachably retained by the detents defined in the forwardly and rearwardly facing edges with a snap fit.

7. The heat exchanger of claim 6, wherein the tubing has an average outside diameter (OD), an average inside diameter (ID) and an average wall thickness (T=(OD−ID)/2), wherein the ratio of(T) to (OD) is between 0.01 and 0.1.

* * * * *